US006619125B2

(12) United States Patent
Laugwitz

(10) Patent No.: US 6,619,125 B2
(45) Date of Patent: Sep. 16, 2003

(54) METHOD AND DEVICE FOR DETERMINING THE DEGREE OF COMPACTION DURING GROUND COMPACTION

(75) Inventor: Niels Laugwitz, Boppard (DE)

(73) Assignee: Bomag GmbH & Co. OHG, Boppard (DE)

( * ) Notice: Subject to any disclaimer, the term of this patent is extended or adjusted under 35 U.S.C. 154(b) by 77 days.

(21) Appl. No.: 09/883,484

(22) Filed: Jun. 18, 2001

(65) Prior Publication Data

US 2002/0003990 A1 Jan. 10, 2002

(30) Foreign Application Priority Data

Jun. 16, 2000 (DE) ..... 100 28 949

(51) Int. Cl.[7] ..... E01C 19/22; E01C 19/41
(52) U.S. Cl. ..... 73/573; 73/579; 404/133.05
(58) Field of Search ..... 73/649, 651, 652, 73/573, 579, 594; 404/117, 122, 133.05

(56) References Cited

U.S. PATENT DOCUMENTS 4,103,554 A * 8/1978 Thurner ..... 404/133.05
4,127,351 A * 11/1978 Vural ..... 404/133.05
4,330,738 A * 5/1982 Paramythioti et al. ..... 318/128
4,546,425 A * 10/1985 Breitholtz ..... 366/128
4,734,846 A * 3/1988 Konig ..... 404/117
5,695,298 A * 12/1997 Sandstrom ..... 404/117
5,727,900 A * 3/1998 Sandstrom ..... 404/122
5,942,679 A * 8/1999 Sandstrom ..... 404/133.05

FOREIGN PATENT DOCUMENTS

| | | |
|---|---|---|
| DE | 25 54 013 B2 | 7/1980 |
| DE | 33 08476 A1 | 10/1983 |
| DE | 27 10811 C2 | 10/1986 |
| DE | 37 07 648 C2 | 2/1996 |
| DE | 694 23 048 T2 | 9/2000 |

OTHER PUBLICATIONS

Die optimale Verdichtung im Erdbau. *bd—baumaschinendienst*, 6:420–423 (Jun. 1983).
*Bauplanung, Bautechnik*, 10:443–448 (Oct. 1982).

* cited by examiner

*Primary Examiner*—Helen Kwok
*Assistant Examiner*—Rose M. Miller
(74) *Attorney, Agent, or Firm*—Baker & Hostetler LLP

(57) ABSTRACT

A method and a device are provided for determining the degree of compaction during ground compaction with a roller or a vibrating plate compactor comprising a top section and a vibrating plate. The method involves determination of one or more amplitude values of the vibration at approximately the excitation frequency of the plate relative to the top section, one or more amplitude values of one or more vibrations of the plate relative to the top section at a maximum of 60% of the excitation frequency, and the quotient of the aforementioned amplitude values as a measure of the current degree of compaction of the ground. The device includes a sensor for non-contact detection of the relative movements between the top section and the vibrating plate or roller.

16 Claims, 4 Drawing Sheets

METHOD AND DEVICE FOR DETERMINING THE DEGREE OF COMPACTION DURING GROUND COMPACTION

BACKGROUND OF THE INVENTION

The invention is directed to a method and device for determining the degree of compaction during ground compaction by means of a vibrating plate compactor or a roller, comprising a top section and a vibrating bottom section and driven with a certain excitation frequency.

In carrying out ground compaction there is basically a desire to obtain a statement of the degree of compaction achieved at any time so as, on the one hand, to be able to guarantee the required compaction values while, on the other hand, obtaining the most efficient possible use of the compaction equipment. In particular, it is desired to cease compaction when further passes are no longer profitable or would even lead to re-loosening of the ground.

Consequently, numerous solutions are already known, involving measurement during the compaction process of certain vibration parameters, which are then used to determine the degree of compaction achieved. However, these systems are in practice suitable only for compaction rollers, and not for vibrating plate compactors. The reason for this is partly the high cost of the equipment, making it uneconomical for vibrating plate compactors, but partly also the much higher acceleration values of the vibration plates, which are around twice the level of those of vibration rollers.

BRIEF SUMMARY OF THE INVENTION

From this starting point the problem of the present invention is to provide a system for determining the degree of compaction which is suitable, not only for rollers but also for vibrating plate compactors, is able to withstand the high acceleration values occurring with the latter, and is particularly distinguished by relatively favorable costs of production.

This problem is solved according to the invention by determining one or more amplitude values of the vibration of the bottom section relative to the top section at the excitation frequency, together with one or more amplitude values of one or more vibrations of the bottom section relative to the top section at a maximum of 60% of the excitation frequency, with the quotient of the aforementioned amplitude values then being used as a measure of the current degree of compaction of the ground.

Studies made by the applicant have revealed, surprisingly, that the quotient defined above rises continuously with the number of passes, and is a reliable indicator for firmness of the ground. As is usual, the value of this quotient depends heavily on the properties of the ground to be compacted and the compaction equipment used, but its relative change from one pass to the next indicates clearly to the operator whether the firmness of the ground has increased, and when further passes are no longer profitable or may even be adverse.

The major advantage of the system according to the invention lies in the fact that no absolute values need to be measured, but only the relative movements between top section and bottom section. These vibration amplitudes may be picked up from the top section without contact, in particular by inductive means. At the same time, no sensor need be attached to the vibrating weight, and problematic cable connections to the vibrating weight are avoided. A further advantage lies in the fact that the amplitudes may be separated according to their frequency relatively inexpensively by electronic means.

The solution according to the invention therefore stands out for its comparatively simple and inexpensive design and its high reliability.

For the amplitude values of the vibration occurring at a maximum 60% of the excitation frequency, it is recommended that a broad frequency band, ranging for example from about 1% to about 50% of the excitation frequency, be taken as a basis. This frequency band may then be utilized over its whole width, or just a relatively small frequency range extending for example from 10 Hz to 20 Hz may be picked out, or several narrow frequency ranges from the specified frequency band may be superimposed.

With regard to the amplitudes occurring at the excitation frequency, it is recommended that a fixed value be specified (preset) for the excitation frequency, i.e. to use the vibration frequency specified by the manufacturer of the compaction equipment as a basis, and to measure the amplitudes for this frequency. However, it is also within the scope of the invention to specify a variable value for the excitation frequency, in particular if the actual excitation frequency is unstable. Recommended in this case is the measurement of a value which is proportional to the excitation frequency. This measured value may then be used for signal filtering, so that the amplitude is measured in each case at the current excitation frequency. The amplitude values of the various frequency ranges may be determined by Fourier transformation, particularly by FFT (Fast Fourier Transformation).

In principle, the amplitude values determined and/or the quotient calculated from them should be averaged, since the signals fluctuate strongly. One measured value per second is quite sufficient. The averaging may be effected, for example, by using envelope curves.

So that the operator can recognize from what point onwards further passes are no longer profitable, a visual or audible signal is expediently generated when the aforementioned quotient passes a defined limit value or its rate of change is too low.

To implement the method described above, it is recommended that the top section have a sensor for non-contact detection of the relative movements between top section and bottom section, in particular a sensor for inductive data acquisition, corresponding to a measuring face lying opposite on the bottom section. This has the advantage that the sensor and its electrical connection are not exposed to the sharp accelerations and decelerations of the vibrating bottom section. The measuring device is therefore distinguished by good reliability and long life, and is especially suitable for vibrating plate compactors.

Preferably, a high-pass filter and a bandpass filter are used to separate the frequency components, with the high-pass filter separating the amplitude value of the vibration occurring at around excitation frequency, and the bandpass filter separating the amplitude value of the vibration occurring at a maximum 60% of the excitation frequency. Preferably, the bandpass filter allows the passage of amplitude values from a frequency range of about 1% to about 50% of the excitation frequency, in practice for example from 1 Hz to 30 Hz, when the excitation frequency is 60 Hz.

Naturally, this bandpass filter may also be replaced by a high-pass filter with a 1 Hz cutoff frequency and a low-pass filter with 30 Hz, connected in series.

For averaging, use may be made either of the amplitude values directly or of the quotients formed from them. In each case, a low-pass filter with a cutoff frequency of about 0.2 Hz to 1 Hz is used.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
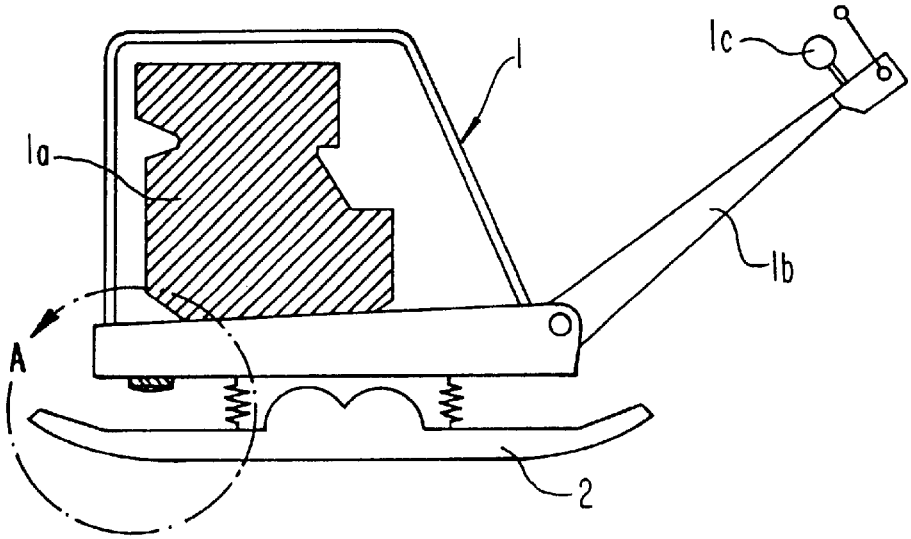
FIG. 1 is a schematic side view of a vibrating plate compactor, equipped with a device according to the invention.

FIG. 1 shows a vibrating plate compactor, known per se, comprising a top section 1 and a vibrating plate 2. The drive motor 1*a* with its accessories is accommodated in the top section 1 in the usual manner. The top section also includes a steering frame 1*b*, so that the operator can control the vibrating plate compactor and steer it in the required direction. At the upper end of this steering frame 1*b*, alongside the usual control elements for switching on and off, and if applicable for varying the frequency, is an indicator 1*c* for the degree of compaction.

The vibration plate 2 has a spring connection with the top section 1 and is set to vibrate by means of eccentric shafts with a defined excitation frequency.

Figure 2:
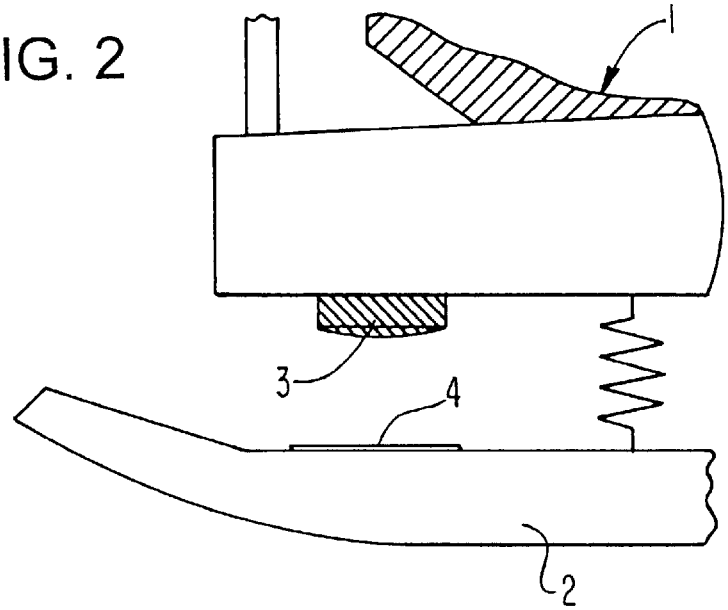
FIG. 2 is a cutout enlargement of detail A of FIG. 1.

The cutout enlargement of FIG. 2 makes clear the principle of measurement. This involves the top section 1, expediently its rigid machine frame, having on the underside a sensor 3 which works in conjunction with a measuring face 4 lying opposite on the top of the vibration plate. In the embodiment shown this sensor is in the form of a displacement sensor. However, it is equally within the scope of the invention to use instead of the vibration displacement, the rate of vibration, the vibration acceleration, or any other characteristic value for the movement of the plate relative to the top section. Measurement is preferably effected in the vertical direction, but may also be at an angle.

Expediently the measurement is inductive, but optical or other methods of measurement are also suitable. But in principle no electrical connection to the vibrating plate should be necessary.

Figure 3:
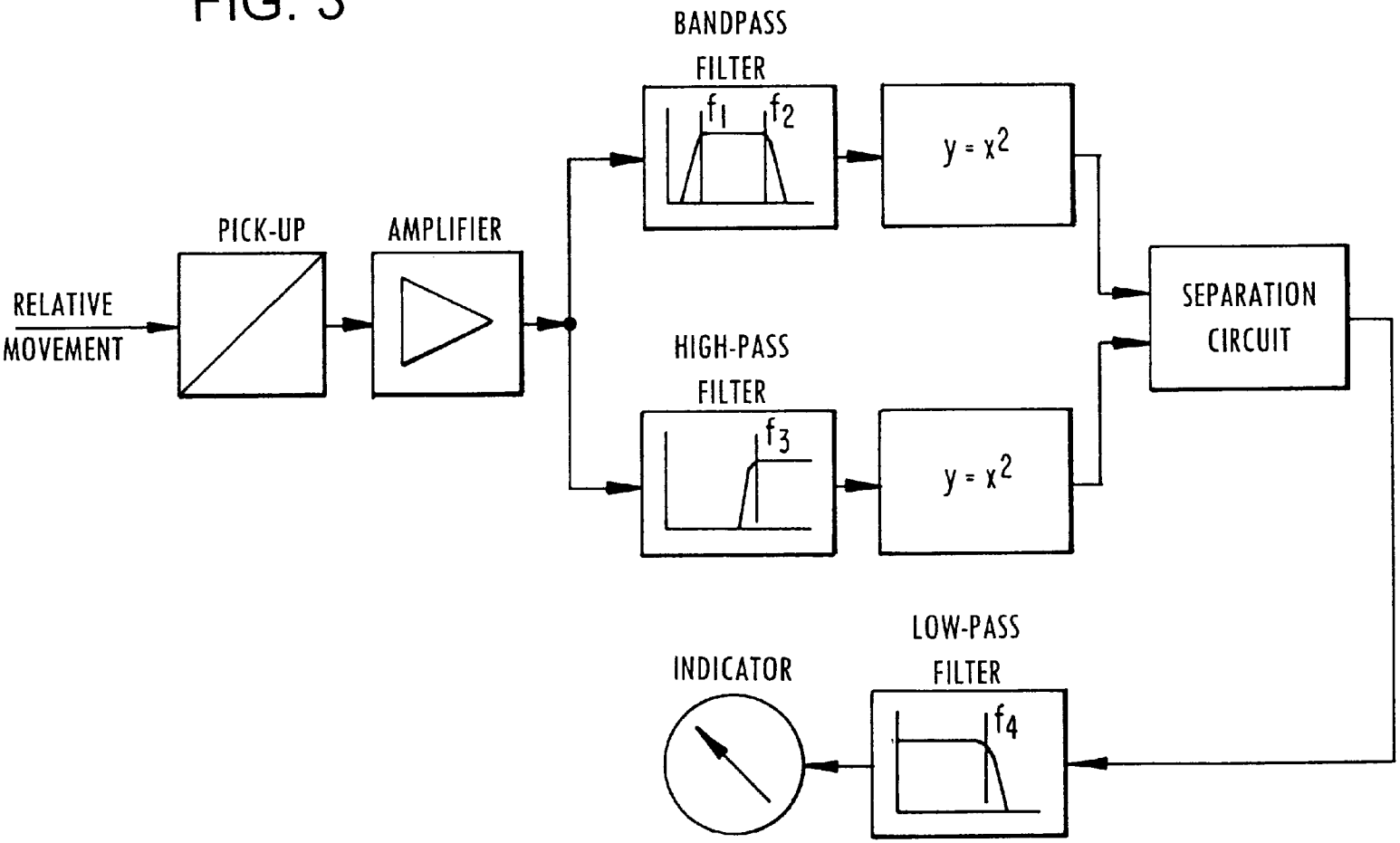
FIG. 3 is a circuit diagram for analysis of the measured values according to the invention.

Analysis of the measured signal is effected as shown in the circuit diagram of FIG. 3. According to this, the displacement signal picked up by the sensor 3 passes first through a transducer and then an amplifier, whereupon the separation of signals to different frequency ranges is made. In the high-pass filter, the vibrations which occur at around the excitation frequency of the vibrating plate compactor are selected. Assuming, for example, a normal vibration frequency of 60 Hz, then the cutoff frequency fs of the high-pass filter is set at just 60 Hz. Instead of this, however, it would also be possible to measure the excitation frequency and to have the high-pass filter follow the excitation frequency actually measured.

Connected in parallel with the high-pass filter is a bandpass filter, which detects the amplitudes from a relatively broad frequency spectrum from about 1% to about 50% of the excitation frequency, in this case from about 1 Hz to about 30 Hz.

The amplitudes of the signals thus separated according to their frequency are then determined, e.g., by generating a value through rectifier bridge circuiting, squaring or peak value measurement. The signals coming from the bandpass filter are then divided by the high-pass filtered signals. This quotient, still widely spread, then passes through a low-pass filter set at a cutoff frequency so low that no sudden jumps in the value to be read from the indicator 1*c* will occur.

Figure 4:
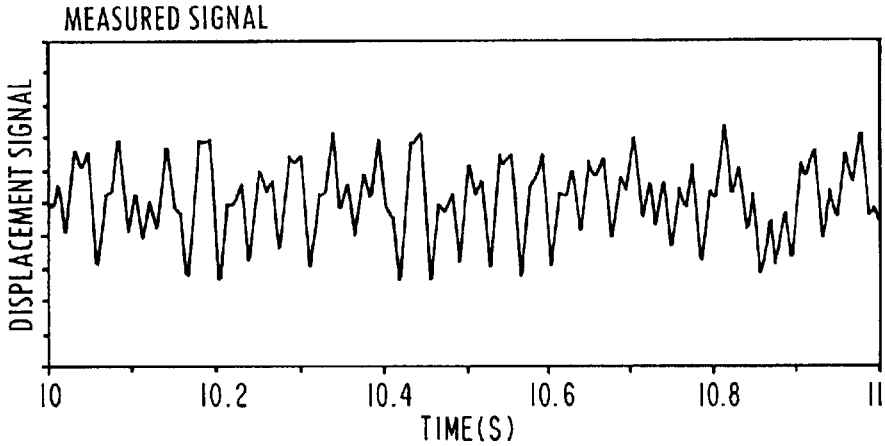
FIG. 4 is a graphical representation of the pattern over time of the signals from displacement measurements according to the invention.
Figure 5:
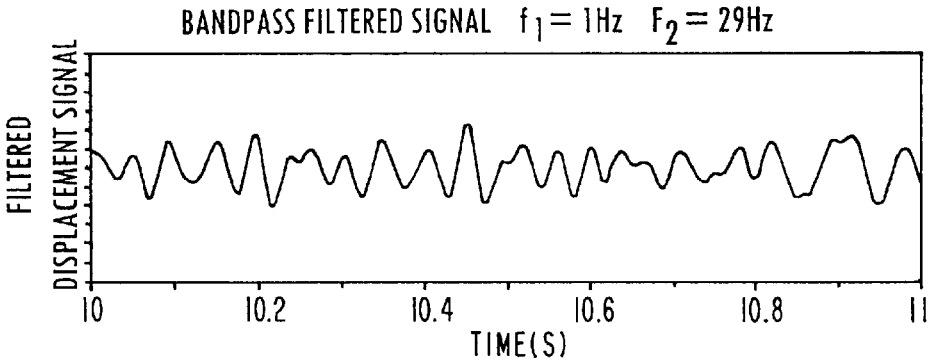
FIG. 5 is a graphical representation of the amplitude response with a frequency range of 1 Hz to 29 Hz.
Figure 6:
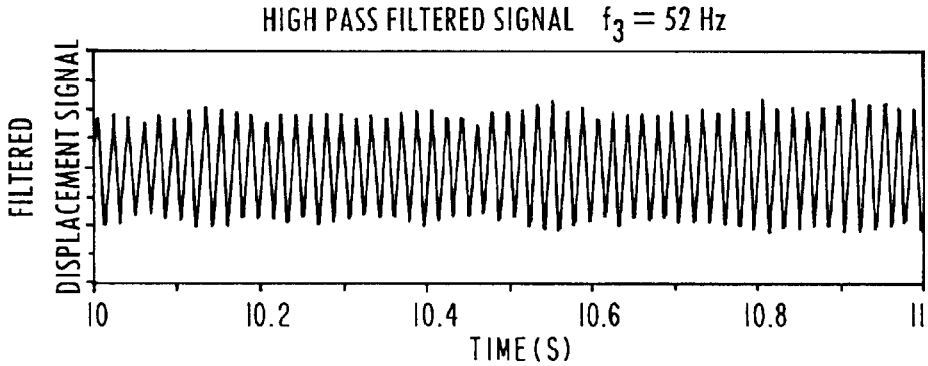
FIG. 6 is a graphical representation of the amplitude response at the excitation frequency of 52 Hz.

FIGS. 4 to 6 show the relevant signal patterns, namely FIG. 4 shows the behaviour of the measured signal before frequency separation; FIG. 5 shows the bandpass filtered signal, i.e., the amplitudes belonging to the vibrations from 1 Hz to 29 Hz: and FIG. 6 shows the high-pass filtered amplitudes belonging to the vibration at around 52 Hz.

Figure 7:
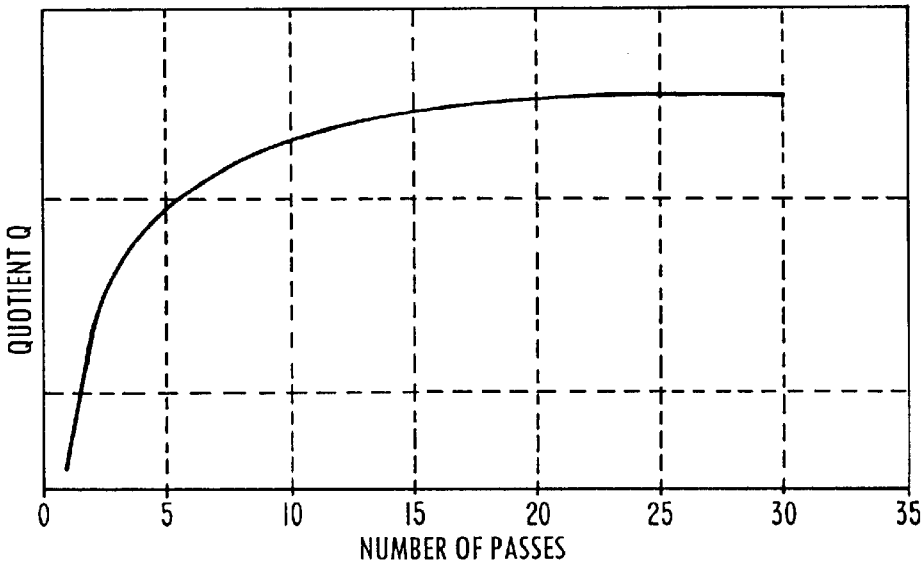
FIG. 7 is a graphical representation of the curve of the quotients over the number of passes.

The quotient Q, i.e., bandpass filtered signals divided by high-pass filtered signals, lies for example between 0.2 and 2.0. Its course over the number of passes is shown in FIG. 7. In qualitative terms it corresponds to the known curves, as also determined before by other methods of measurement, and indicates to the operator, where necessary supported by an audible signal, the point from which further passes with the compaction equipment are no longer profitable.

To summarise, an advantage of the invention is that it provides a reliable means of determining the degree of compaction for rollers or vibrating plate compactors, with low and cost-effective outlay on equipment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of determining a degree of compaction during ground compaction with a vibrating plate compactor or a roller having a top section (1) and a vibrating bottom section (2), driven at a defined excitation frequency, comprising the steps of determining at least one amplitude value of a vibration at approximately an excitation frequency of the bottom section (2) relative to the top section (1), determining at least one amplitude value of one or more vibrations of the bottom section (2) relative to the top section (1) at a maximum of 60% of the excitation frequency, and calculating a quotient of the amplitude values as a measure of the current degree of compaction of the ground.

2. The method according to claim 1, wherein a fixed value for the excitation frequency is preset for measurement of the amplitudes at excitation frequency.

3. The method according to claim 1, wherein the step of determining the amplitudes at excitation frequency comprises inputting a variable value for the excitation frequency corresponding to its actual current value.

4. The method according to claim 1, wherein the amplitude values determined and/or the quotient are subjected to averaging.

5. The method according to claim 4, wherein averaging is effected using envelope curves.

6. The method according to claim 1, wherein the amplitude values of the various frequency ranges are determined by Fourier transformation and are used to calculate the degree of compaction.

7. The method according to claim 6, wherein the Fourier transformation is a Fast Fourier Transformation (FFT).

8. The method according to claim 1, wherein a signal is generated for the operator when the quotient exceeds a defined limit value.

9. A method of determining a degree of compaction with a vibrating plate compactor or a roller having a top section and a vibrating bottom section, driven at a defined excitation frequency, comprising the steps of determining at least one amplitude value of vibration at approximately an excitation frequency of the bottom section relative to the top section, determining at least one amplitude value of one or more vibrations of the bottom section relative to the top section at a maximum of 60% of the excitation frequency, and calculating a quotient of the amplitude values as a measure of the current degree of compaction of the ground;

wherein the amplitude values of the vibration at a maximum 60% of the excitation frequency are collected from a broad frequency band.

10. The method according to claim 9, wherein the amplitude values from a frequency band of about 1% to about 50% of the excitation frequency are collected.

11. A device for determining a degree of compaction during ground compaction with a vibrating plate compactor or a roller, comprising a top section and a vibrating bottom section, driven at a defined excitation frequency, wherein the top section has a sensor for non-contact detection of relative movements between the top section and the bottom section that determines amplitude values of vibration of the bottom section; and an indicator that indicates the degree of compaction of the ground by calculating a quotient of the amplitude values.

12. The device according to claim 11, wherein the sensor corresponds with a measuring face which lies opposite thereto on the bottom section.

13. The device according to claim 12, wherein the sensor is a sensor for inductive data acquisition.

14. The device according to claim 11, wherein the sensor is a displacement pick-up.

15. The device according to claim 11, further comprising a high-pass filter for determining amplitude values of vibration of the bottom section relative to the top section occurring at approximately the excitation frequency.

16. A device for determining a degree of compaction during ground compaction with a vibrating plate compactor or a roller, comprising a top section and a vibrating bottom section, driven at a defined excitation frequency, wherein the top section has a sensor for non-contact detection of relative movements between the top section and the bottom section; a bandpass filter for determining amplitude values from a frequency range of about 1% to about 50% of the excitation frequency that determines amplitude values of vibration of the bottom section; and an indicator that indicates the degree of compaction of the ground by calculating a quotient of the amplitude values.

* * * * *